US010030506B2

(12) United States Patent
Fanini et al.

(10) Patent No.: US 10,030,506 B2
(45) Date of Patent: Jul. 24, 2018

(54) DOWNHOLE FLUID MONITORING SYSTEM HAVING COLOCATED SENSORS

(71) Applicant: Baker Hughes Incorporated, Houston, TX (US)

(72) Inventors: Otto N. Fanini, Houston, TX (US); Mohamed Daoud, The Woodlands, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 87 days.

(21) Appl. No.: 14/832,037

(22) Filed: Aug. 21, 2015

(65) Prior Publication Data

US 2017/0051606 A1 Feb. 23, 2017

(51) Int. Cl.
*E21B 47/10* (2012.01)

(52) U.S. Cl.
CPC ..... *E21B 47/10* (2013.01)

(58) Field of Classification Search
CPC ..... E21B 47/10
USPC ..... 73/152.32
See application file for complete search history.

(56) References Cited

U.S. PATENT DOCUMENTS 4,951,749 A * 8/1990 Carroll ..... B01D 29/111 166/100
7,114,386 B1 10/2006 Veignat et al.
7,520,162 B2 4/2009 Wenger et al.
7,600,419 B2 10/2009 Oddle
7,733,490 B2 6/2010 Goodwin et al.
7,784,339 B2 8/2010 Cook et al.
8,056,619 B2 11/2011 Patel et al.
8,073,640 B2 12/2011 Andle et al.
2011/0100112 A1* 5/2011 Du ..... E21B 47/10 73/152.32
2013/0081459 A1* 4/2013 Memiche ..... E21B 47/10 73/152.29
2014/0300889 A1* 10/2014 DiFoggio ..... G01N 21/4133 356/51
2015/0376963 A1* 12/2015 Orban ..... G01N 11/00 175/48

* cited by examiner

*Primary Examiner* — Roy Y Yi
*Assistant Examiner* — Philip Marcus T Fadul
(74) *Attorney, Agent, or Firm* — Bracewell LLP; Keith R. Derrington

(57) ABSTRACT

A downhole device for use in a wellbore that has sensors for monitoring flow rates and fluid properties of fluid flowing in the wellbore. The sensors are disposed adjacent one another so that the properties of the fluid monitored by the sensors are substantially the same. The sensor for monitoring flow rate is a flow meter optionally equipped with rotatable members that are affixed to a rotatable base member. The members are positioned in a path of the flowing fluid which rotates the members and base member; the fluid flow rate is estimated based on a measured rotational rate of the base member. Properties estimated by the fluid property sensor include viscosity and density. The fluid property sensor can include a resonating member disposed in the fluid flow path, by measuring the damping of the fluid across the resonating member, the fluid density and viscosity can be estimated.

10 Claims, 5 Drawing Sheets

DOWNHOLE FLUID MONITORING SYSTEM HAVING COLOCATED SENSORS

BACKGROUND OF THE INVENTION

1. Field of Invention

The present disclosure relates in general to a system for use in monitoring flow in a well bore. More specifically, the present disclosure relates to a downhole fluid monitoring system having sensors that are located adjacent one another, and that monitor concurrently and simultaneous different fluid parameters and properties.

2. Description of Prior Art

Various types of devices are disposed downhole for monitoring parameters of fluid flowing within a wellbore. Typically fluid parameters monitored downhole include a flowrate of fluid flowing downhole, fluid properties, and fluid conditions. Fluid properties monitored generally include fluid density and viscosity, whereas fluid conditions include fluid pressure and temperature. Flowmeters are often used for measuring fluid flow, and may be deployed downhole within a producing wellbore, a jumper or caisson used in conjunction with a subsea wellbore, or a production transmission line used in distributing the produced fluids. Monitoring fluid produced from a wellbore is useful in wellbore evaluation and to project production life of a well. Fluid density and viscosity are usually measured to estimate the type of fluid flowing in the monitored portion of the wellbore, i.e. oil, water, gas. A further determination of the fluid downhole can be verified by readings of temperature and/or pressure.

As is known, the downhole in-situ conditions of temperature and pressure can change significantly depending on the location in the borehole. Fluid properties, such as viscosity and density are dependent on fluid temperature and pressure, thus these properties for the same fluid can change depending on where the fluid is in the wellbore. Additionally, dissimilar types of fluids that are connate in the formation can migrate into the wellbore thereby further altering the properties of the fluid flowing in the wellbore. Currently, downhole sensors for measuring fluid properties and sensors for measuring flow, are disposed at different places in the wellbore or are spaced sufficiently far apart from one another that the fluid being monitored has different fluid properties when evaluated by these spaced apart sensors. Accordingly, these readings are susceptible to error if a flow rate calculation is based on an inaccurate value of fluid property.

SUMMARY OF THE INVENTION

Disclosed herein is an example of a downhole device for use in a wellbore and which includes a housing and a sensor assembly coupled with the housing. The device can be permanently disposed downhole, or conveyable and thus temporarily disposed downhole. The sensor assembly includes a fluid flow meter and a fluid property sensor at a location proximate the fluid flow meter. In this example, when fluid in the wellbore flows past sensor assembly, properties of the fluid adjacent the fluid flow meter are substantially the same as properties of the fluid adjacent the fluid property sensor. In one embodiment, the fluid flow meter includes blades disposed in a plane that is generally perpendicular to an axis of the housing. Alternatively, the fluid flow meter has blades mounted on a frame that is rotatable about a path that circumscribes the fluid property sensor. In this example, the frame mounts to an annular lower housing, wherein a spindle provided on the housing inserts into the lower housing, and wherein the lower housing is rotatable with respect to the spindle. This example can further include a transformer in one of the spindle or lower housing, and a transformer sensor in the other one of the spindle or lower housing for monitoring a rate of rotation of the blades. The example further optionally includes a region of varying capacitance in one of the spindle or lower housing, and a capacitive sensor in the other one of the spindle or lower housing for monitoring a rate of rotation of the blades. In one example, the fluid property sensor is made up of elongate members, so that when the elongate members are subjected to a resonating frequency and disposed in a path of fluid, measuring a damping response of the elongate members yields a property of the fluid. In this example, the fluid flow meter has blades mounted on a frame that is rotatable with respect to the housing, and wherein a space is formed within the frame, and wherein the fluid property sensor is disposed within the space. The frame can be a screen cage that has a generally cylindrical shape. The downhole device can include a controller in communication with at least one of the sensors. Optionally, the downhole fluid monitoring system can have one or multiple similar sensor sets located across the flow path, that sensors in each set can be located sufficiently adjacent one another, and that each sensor set monitor concurrently and simultaneously different fluid parameters and properties of the fraction of the flow volume within survey reach of each sensors set. This sensor arrangement enables the analysis, identification, troubleshooting and quantification of multiple reservoir production flow regimes.

Another example of a downhole device for use in a wellbore includes a housing, a spindle on an end of the housing, a fluid sensor assembly mounted on spindle and selectively disposed in a flow of fluid in the wellbore. The fluid sensor includes a fluid flow meter having a lower housing that rotatingly couples to the spindle, a frame coupled with the lower housing, and blades on the frame that are in contact with the flow of fluid. The fluid sensor further includes a fluid property sensor set at a location proximate the fluid flow meter so that fluid in the flow of fluid has fluid properties that are substantially the same when fluid contacts the blades and when the fluid is sensed by the fluid property sensor. The example of the frame has a cylindrically shaped outer surface and openings in the surface so that fluid in the flow of fluid flows through the openings to the fluid property sensor. Further optionally included is an electromagnetic source in one of the spindle or the lower housing that is sensed by an electromagnetic receive disposed in the other one of the spindle or lower housing. The fluid property sensor can be a resonating member, and wherein the member is damped by fluid flowing across the member.

Also described herein is a method of monitoring a flow of fluid in a wellbore, and which includes monitoring a flow rate of the flow of fluid at a location in the wellbore and monitoring a property of the fluid in the flow of fluid in the wellbore where properties of the fluid are substantially the same as properties of the fluid at the location in the wellbore. The flow rate of the fluid can be measured using a flow meter having blades that rotate in response to the flow of fluid flowing past the blades. The steps of monitoring the flow rate of the flow of fluid and monitoring the property of the fluid in the flow of fluid can occur at substantially the same time. The step of monitoring a property of the fluid in the flow of fluid can involve disposing an elongate member into a path of the flow of fluid, applying a resonating frequency to the elongate member, and measuring an amount of damping exerted onto the elongate member by the flow of fluid. The property of the fluid being measured can be density; in this embodiment, the method can further include monitoring viscosity of the fluid and a refractive index of the fluid. The method can further include estimating information about the composition of the flow of fluid based on the steps of monitoring.

BRIEF DESCRIPTION OF DRAWINGS

Some of the features and benefits of the present invention having been stated, others will become apparent as the description proceeds when taken in conjunction with the accompanying drawings, in which.

Figure 1:
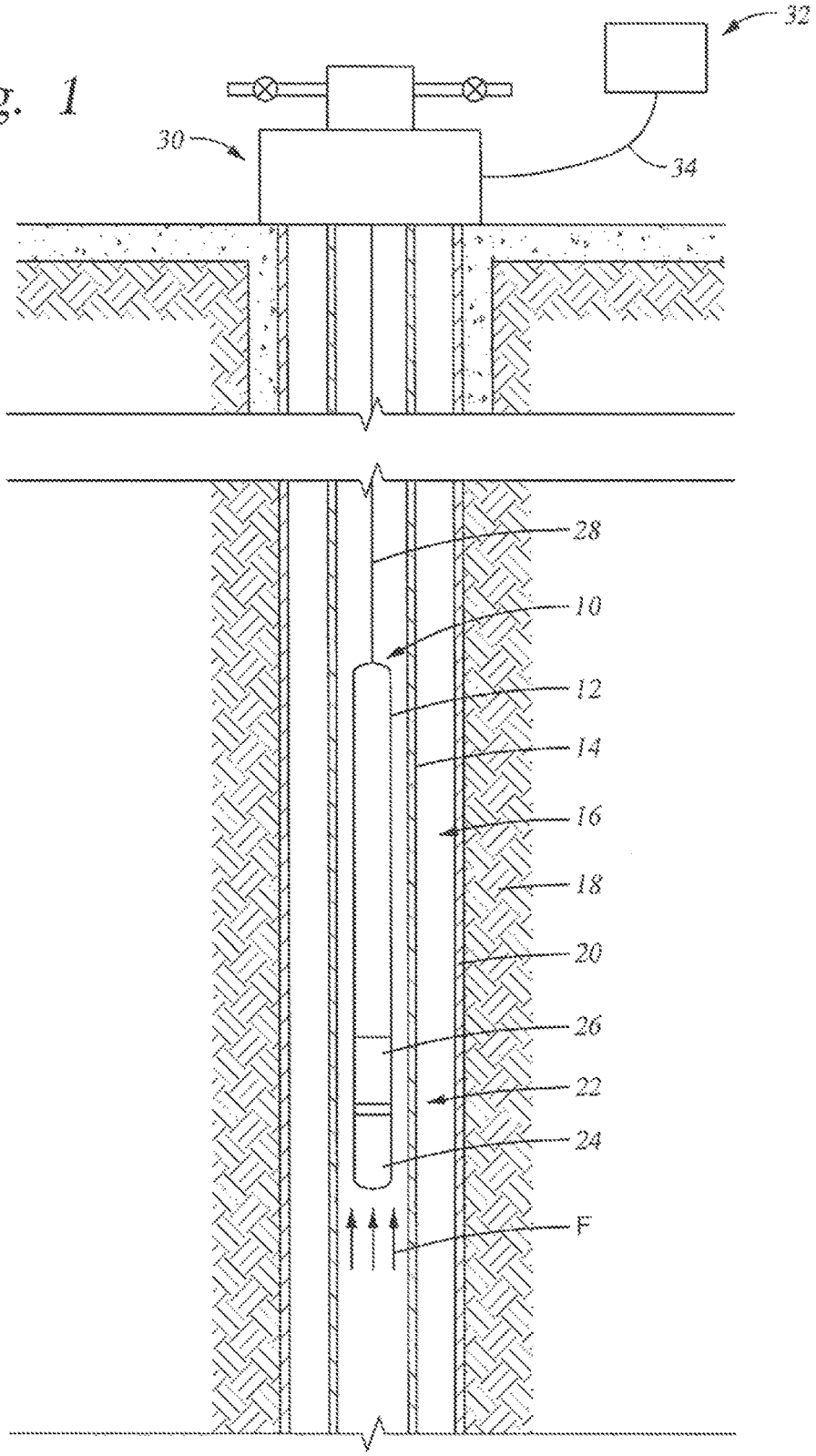
FIG. 1 is a side partial sectional view of an example of a downhole device disposed in a wellbore and which has a sensor assembly for sensing fluid in the wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will folly convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a partial side sectional view in FIG. 1 is one example of a downhole device 10 which has an elongate housing 12 and is disposed in a length of production tubing 14. Tubing 14 is installed in a wellbore 16 that is shown intersecting a formation 18. Casing 20 lines the wellbore 16 and provides selective isolation of wellbore 16 from formation 18. Perforations (not shown) may be selectively formed through the casing 20 to allow fluid within formation 18 to make its way into wellbore 16 and into production tubing 14. A flow of fluid F produced from within formation 18 is shown within tubing 14 and making its way towards housing 12. Examples exist wherein the flow of fluid F includes liquid, gas, vapor, condensate, and combinations thereof. A sensor assembly 22 is coupled to housing 12 and which is equipped for monitoring information about the flow of fluid F. Included with sensor assembly 22 is a flow meter 24 for estimating a flow rate or velocity of the flow of fluid F. Also included with sensor assembly 22, and adjacent to flow meter 24, is a fluid property sensor 26. Fluid property sensor 26 is strategically disposed proximate to flow meter 24 such that the properties of the fluid in the flow of fluid F are substantially the same when they encounter both the flow meter 24 and fluid property sensor 26.

Downhole device 10 is shown deployed within wellbore 16 on a conveyance means 28, that can be a wireline, coiled tubing or slick line. Conveyance means 28 depends into the wellbore 16 from a wellhead assembly 30 shown on surface and mounted at an opening of the wellbore 16. Conveyance means 28 can connect to a surface truck (not shown) on the surface and disposed outside of wellbore 16. A controller 32, which may be included within surface truck, is shown coupled with a communication means 34. Communication means 34 can enable communication between controller 32 and downhole device 10 via conveyance means 28. Controller 32, which can be any type of information handling unit, can include a processor for processing data received from downhole device 10 as well as for transmitting instructions from controller 32 to downhole device.

Figure 2:
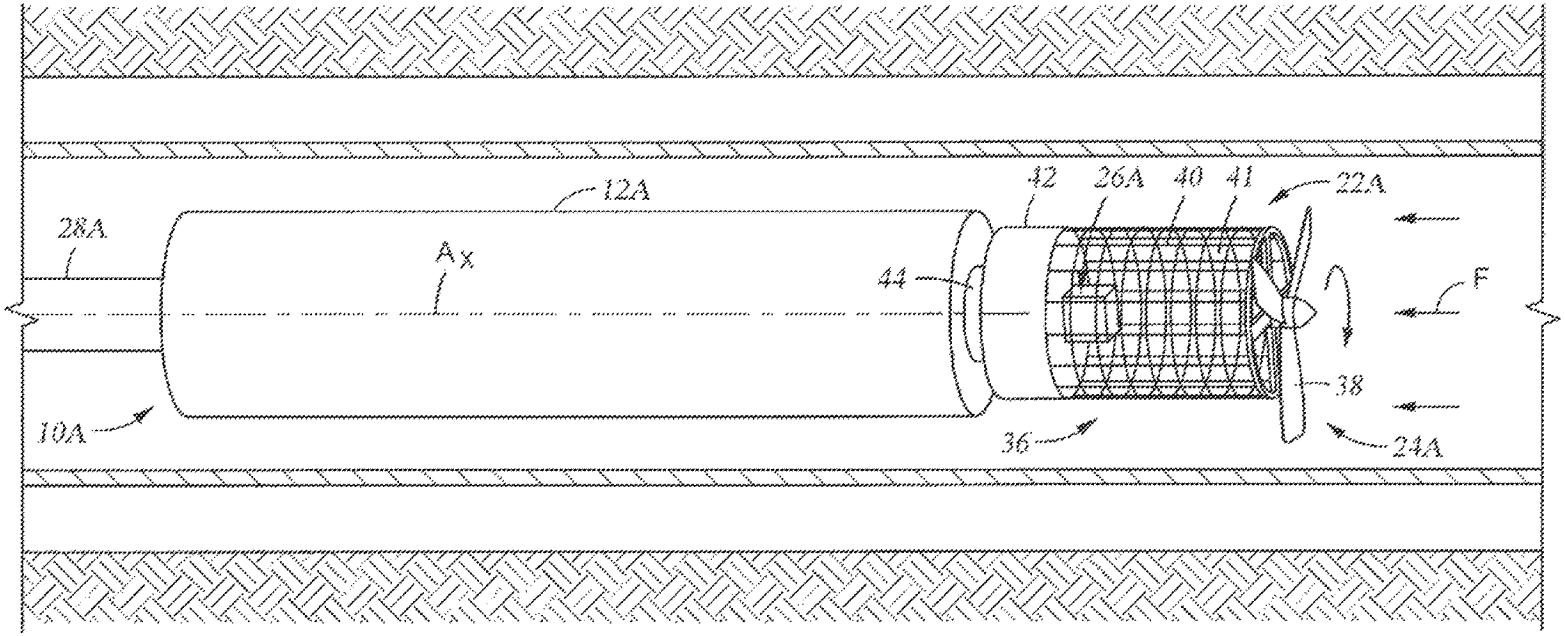
FIG. 2 is a side partial sectional view of an example portion of the downhole device of FIG. 1 having the sensor assembly.

In the example of FIG. 2, an alternate embodiment of a downhole device 10A is shown in a side perspective view where the flowmeter 24A is shown made up of a frame 36. Frame 36 is illustrated in this example as having a generally cylindrically shaped outer surface. Further shown in the illustrated embodiment are blades 38 mounted on one end of the frame 36. The blades 38 are generally elongate members that project radially outward from an axis $A_X$ of housing 12A and whose surfaces are disposed generally oblique to a direction of the flow of fluid F. As such, when set in the path of a flow of fluid F, a lateral force is imparted onto blades 38, and which is transferred to frame 36 via coupling of the blades 38 to frame 36. The present disclosure is not limited to the example of the blades 38 illustrated, but can include anything that produces rotation of the frame 36 in response to fluid flowing past the frame 36. The triune 36 is shown as being formed from a number of elongate members 40 and which are spaced apart from one another to create openings 41 through the side wall of the frame 36 through which fluid can flow freely. Flow meter 22A is shown further included a lower housing 42, which as illustrated mounts to an end of frame 40 distal from blades 36. Lower housing 42 is shown as having a generally curved outer surface and resembling a cylinder. Lower housing 42 is rotatable with respect to housing 12A, so that the lateral force from the flow of fluid F onto blades 38 and frame 36 thereby can create rotation of blades 38, frame 36, and lower housing 42 with respect to housing 12A. Lower housing 42 is shown coaxially mounted over a spindle 44, which is a generally cylindrically shaped member that projects axially outward from an end of housing 12A. An example of fluid property sensor 26A is shown mounted onto a surface of spindle 44 and projecting into a space within frame 36.

Strategically locating the working components of the flow meter 24A with proximity to the fluid property sensor 26A ensures to the properties of the fluid in the flow of fluid F is substantially the same when it contacts the blades 38 and when it is monitored by the fluid property sensor 26A. In an example embodiment, the fluid property sensor 26A includes a member that is resonated within the flow of fluid F; damping created by the flow of fluid F onto the resonating member can be optionally monitored so that a fluid property can be estimated. Optionally, an optical sensor can be provided within fluid property sensor 26A for selectively assessing an optical characteristics of the fluid in the flow of fluid F. Examples of fluid properties that may be obtained by the fluid property sensor 26A include viscosity and density of a fluid in the flow of fluid F. The conveyance means 28A as shown in FIG. 2 is illustrated as being a length of coiled tubing.

Figure 3:
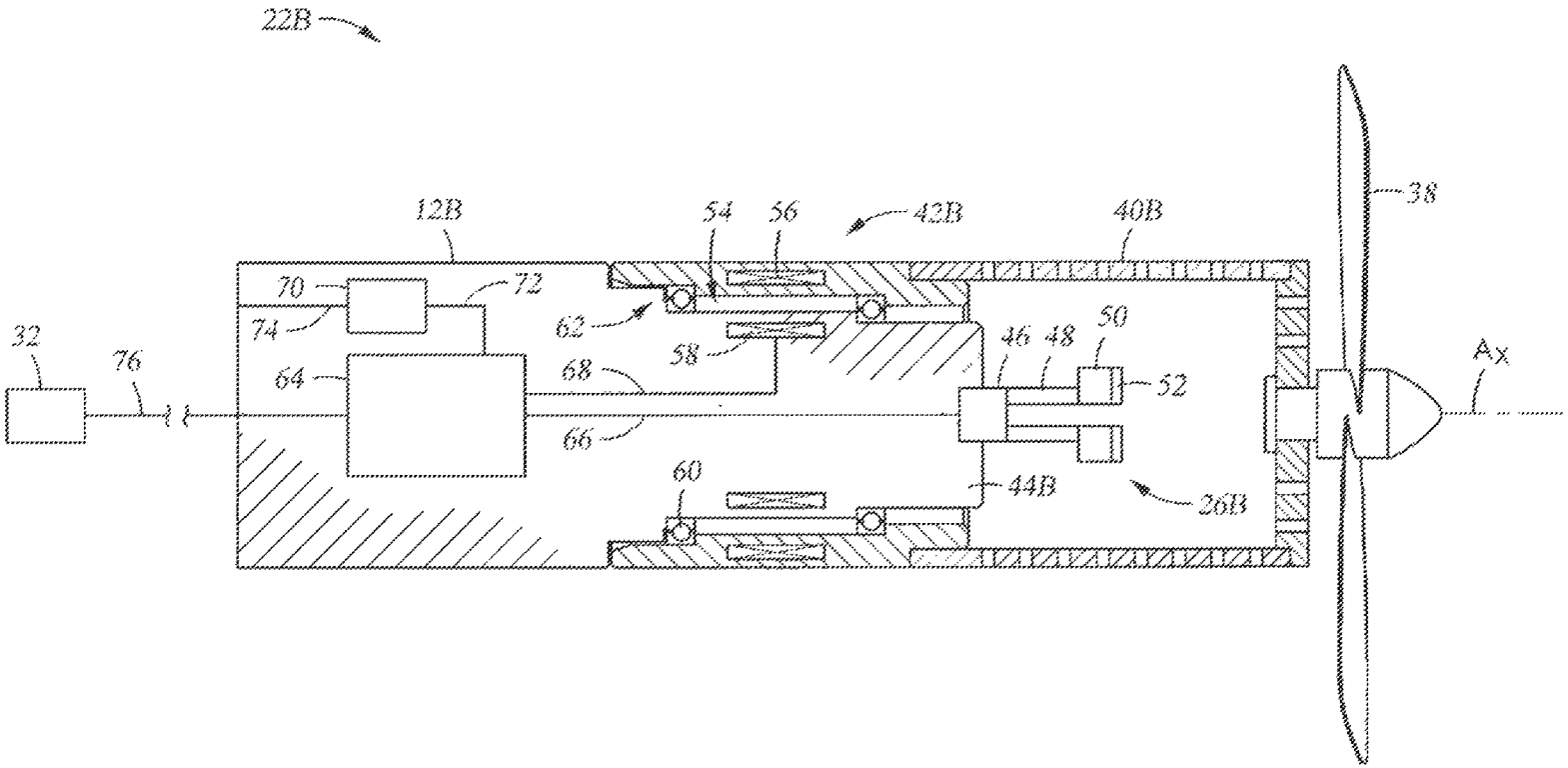
FIG. 3 is a side sectional view of an example embodiment of the sensor assembly of FIG. 2.
Figure 4:
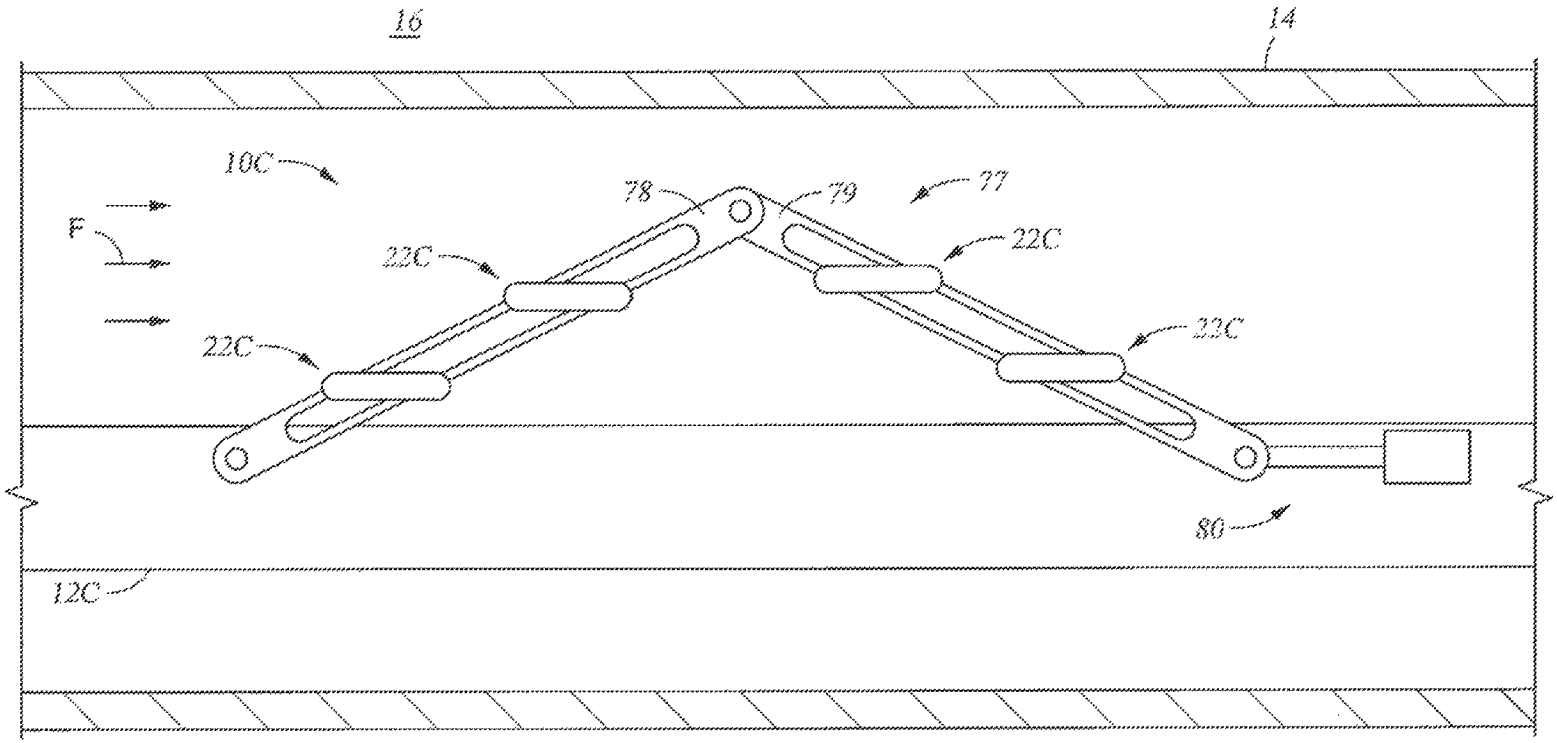
FIG. 4 is a side view of an alternate embodiment of the downhole device having an example of a sensor array.

FIG. 3 shows in a side sectional view another example of sensor assembly 22B. In this example fluid property sensor 26B is shown having a base member 46 mounted on an end of spindle 44B. Cantilevered elements 48 are shown extending from base member 46 in a direction away from spindle 44B. In one example embodiment, the cantilevered elements 48 are tines. On the free ends of the cantilevered elements are heads 50 which are shown having a greater thickness than the cantilever elements 48. Further optionally include are amounts of magnetized material 52 disposed on the surfaces of the heads 50 distal from their connection to the cantilevered elements 48. Optionally, the material 52 can be embedded in the heads 50. Also optionally, the fluid property sensor 26B can be any type of mechanical resonator, i.e. tuning fork, cantilever, bimorph, unimorph, fractal structures, and the like, and combinations thereof. In an example, a controller generates an excitation signal to the resonator via wires embedded therein (not shown). Examples exist wherein the vibration excitation force ranges up to around 1 Mhz. Inputs can be in the form of a step pulse; impulse stimulus (optionally approximation to an impulse like sin x/x); direct current, directly fluid induced pressure pulse, alternating current or impulse applied to a piezoelectric source, magneto-restrictive materials, electro-restrictive materials, elasto-optic materials, anisotropic materials or combination, coil or at least a pair of coils with a magnet or coil without magnet to generate an electromotive force causing an excitation vibration therefor causing an excitation vibration in the mechanical resonator (tuning fork). The measurement could be performed in the frequency domain (steady harmonic vibrations) or time domain (transient excitation and responses). Materials can be metallic, crystalline or amorphic (ceramic) structures. A vibration response detector in the mechanical resonator can detect resonance motion, for example, through a magnetically cross-coupled signals between mechanical resonator elements. The mechanical resonator excitation and response signals can be analyzed to determine a resonance response of the second order transfer function with attenuation and phase used to determine viscosity and density of the fluid.

As illustrated in FIG. 3, the end of lower housing 42B is distal from frame 40B includes a cylindrically shaped cavity 54 formed for insertion of spindle 44. Further included within lower housing 42B is an emitter 56, and a detector 58 is shown formed within spindle 44B, where emitter 56 and detector 58 are set radially apart and each extend along a discrete angular distance around the axis $A_X$ of the sensor assembly 22B. In an example, detector 58 is equipped to sense when emitter 56 is within a designated proximity of detector 58. Thus as lower housing 42B rotates with respect to spindle 44B, and emitter 56 orbits past detector 58, detector 58 can indicate each instance and when the emitter 56 passes through the designated proximity. Accordingly, the number and rate of rotations of lower housing 42B with respect to spindle 44 can be estimated based by sensing the proximity of emitter 56 to detector 58. Example emitters and detectors can include electromagnetic elements as well as capacitive elements. To facilitate rotation of lower housing 42 with respect to spindle 44, bearings 60 are shown provided in recesses 62; where recesses 62 extend from within the outer surface of spindle 44 and radially outward a distance into an inner surface of housing 42B thereby intersecting cavity 54.

Still referring to FIG. 3, a controller 64 is shown disposed within housing 12B and that is in communication with fluid property sensor 26B via line 66. In one example of operation, controller 64 can deliver an electrical signal to 26B that can induce resonant vibration of the cantilevered members 48. The amount of damping experienced by cantilever members 48 can be selectively monitored, and data representing the amount of damping can be transferred back to controller 64 via line 66. The amount of damping in one example is monitored based upon signals generated between the magnetized material 52 created by their moving proximate to one another. Similarly, the amount of rotation sensed by detector 58 can be transmitted to controller 64 via line 68. Example embodiments exist, where line 66, 68 are hardwired, fiber optic wireless, or any other manner of transmitting a signal. Further included in the example of FIG. 3 is a power supply unit 70 which is in communication with controller 64 via line 72. Power supply unit 70 can selectively provide power both to controller 64 and electricity for creating resonance within the cantilevered elements 48 of the fluid property sensor 26B. Communication to and from power supply unit to surface may be conducted through a power signal bus 74 shown connected to a side of power supply unit 70 opposite its connection to line 72. Further, controller 64 may be selectively in communication with controller 32 via communication means 76. Communication means 76 can be hardwired, wireless, fiber optic, a form of telemetry, or any other type of communication medium.

Optionally, the emitter 56 and detector 58 of FIG. 3 include non-magnetic components, such as a rotating transformer, or a varying coupling impedance (magnetic flux or capacitive sensing) which correlate to the shall angular position. Moreover, this function may operate at one or more discreet frequencies. Further optionally, the embodiment of the fluid property sensor 26B of FIG. 3 can be referred to as a tuning fork sensor. Additionally, the magnetized material 52 on the ends of the heads 50 can be replaced with a non-magnetic component that is operating at a sweeping range of sensing frequencies. The non-magnetic components can be electrode pairs that sense electrical impedance (phase and attenuation over a designated frequency range) between the collocated electrodes, between the electrode in a device body surface that would be sensitive to production flow material passing through and within the housing 40B, between the electrode of two sensor assemblies, or between an electrode in the sensor assembly and the device body 12B. This electrical impedance measurement can assist the quantitative evaluation of the flow of fluid F and its phase content, that is the oil, water, gas or the ratio thereof and ratio flow volume content variations. Moreover these measurements can be taken at one or more discreet frequencies or over a range of frequencies. The sensors can be stationary, or mechanically attached to the main device body and centrally located and protected by the rotating screen cage. The sensors described herein can be electrically connected to device signal detector amplifiers (not shown) and controllers 32, 60 via pressure feed through connections within housing 12B. Measurements taken by sensors within the sensor assembly 22 can be used with interpretation methods and raw data calibration that are based on quantitative models and verified characterization described in the respective physical behavior and measurement sensitivities. In one example of operation, three sets of non-interfering frequencies (including harmonics and cross modulations) are performed, and used for determining shaft position, output from the tuning fork and electrode impedance measurements. Measurements can be indexed, tagged, and synchronized to a real time clock and well depth, orientation, or reservoir position correlated and indexed (spatially, time, and multi-dimensional flow property sounding). In an alternative, the blade 38 (or its alternative) can be equipped to sense impedance upstream of heads 50 so that any variations in the fluid properties between when measured by the blade 38 and material 52 thereby providing a time differential stamp on the measurements. In an example, the magnetized material 52 makes up electrodes, that can be frequency tuned and have a coaxial connection feed around a fiber optic core; and thus can sense localized and collocated impedance data. In an example the impedance data is a function of sigma (conductivity) and dielectric constant. Impedance measurement electrode pairs mounted with the pair of optionally magnetized material sensor components 52 could be driven by a common-mode signal connected to a center tap of mechanical resonator excitation coils (not shown) or driving electrodes of a piezoelectric vibration source (not shown) to minimize wiring of collocated sensors wiring and cross-section of wire bundles. In one example, the frequency dependent conductivity impedance measured between adjacent impedance measurement electrode pairs mounted with optionally magnetized material sensor component 52 follows the form $\sigma_{ac}(\omega, T)=\sigma_{dc}(T)+A\omega^{S(T,\omega)}$ (one form of Jonscher's power law relationship with a frequency and temperature dependent exponent) where: $\omega$ is angular frequency (equal 2 times pi times frequency); $\sigma_{dc}$ is a non-frequency dependent and temperature dependent conductivity impedance component; the impedance component $A\omega^{S(T,\omega)}$ is the frequency and temperature dependent component of the conductivity impedance measured between electrodes. A is a constant multiplicative factor, $S(T,\omega)$ is an frequency and temperature dependent exponent. The universality of such empirical power—law behavior is valid for many classes of materials characterized by Jonscher, sometimes referred to as "universal dynamic response" (UDR). The "universal dynamic response" of the impedance measurement with electrodes as described in this invention can be applied for electrochemical impedance spectroscopy (EIS) interpretation techniques to identify and analyze with multivariate interpretation methods the composition of the reservoir production fluid flow content in the sensors' vicinity what can be effectively achieved with collocated sensors as described herein. In an embodiment, the power factor n can vary between fluids and transition its value within well specified frequency regions which can be related to dielectric dispersion characterization for fluids. Impedance measurements dependent of fluid frequency have in some examples been shown to be also a function of temperature, which can be measured by the collocated sensors. The type of fluid being sensed can be identified by analyzing complex impedance measurements obtained with the electrodes over a sufficiently broad frequency range (electrochemical impedance spectroscopy also known as EIS). In an example of operation, the optical probe is used to identify when the gas flow phase is in contact with the collocated sensor assembly; in this example the electrode pairs can be activated to measure frequency dependent impedance containing an estimate of the gas-phase dielectric assisting in typing the gas mixture and provide inputs to conduct material balance calculations for the well production.

Figure 6:
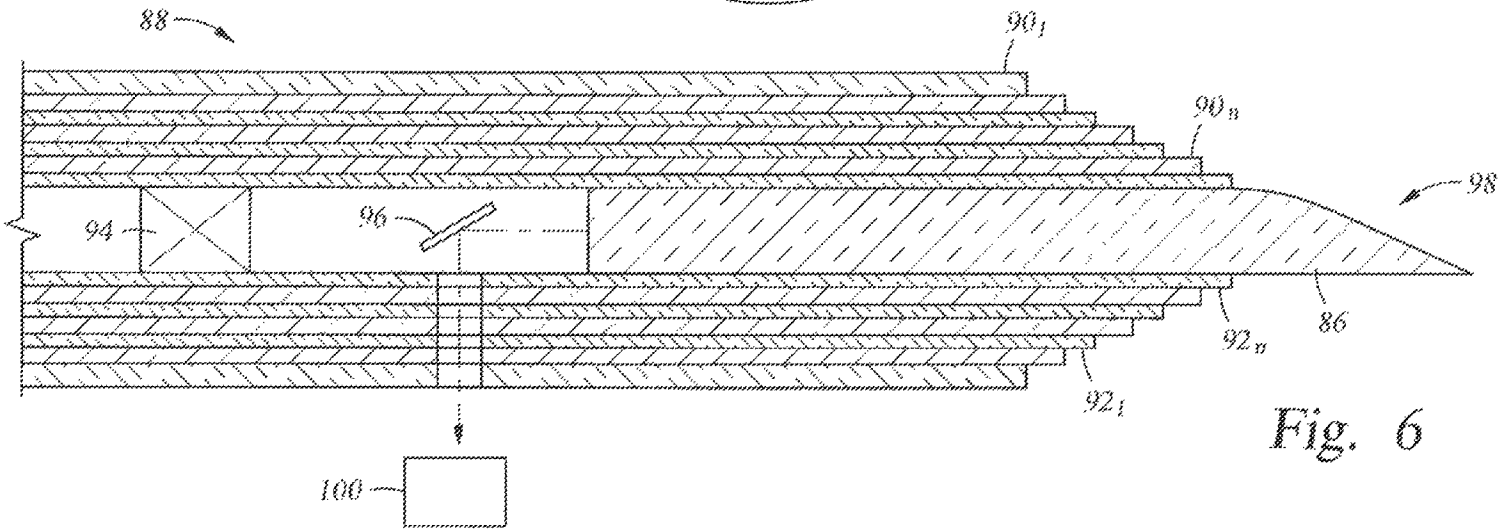
FIG. 6 is a side sectional view of an example of an optical sensor circumscribed by a conductor assembly.

FIG. 6 shows in a side view an alternate embodiment of downhole device 10C and having a sensor array 77 pivotingly mounted on its housing 12C. Sensor array 77 includes articulated arms 78, 79 that are pinned to one another. Examples exist where a plurality of arms 78, 79 are included with the device 10C that are at the same or different axial locations on the device 10C. An end of arm 78 distal from arm 78 pivotingly couples to the housing 12C. An end of arm 79 distal tan arm 78 pivotingly couples to a deployment system 80, which includes a linear motor and rod, wherein the rod is axially reciprocating to push the end of arm 79 axially towards and away from arm 78. This reciprocating action urges the ends of arms 78, 79 coupled to one another radially outward from housing 12C and into the annul us between housing 12C and wall of tubing 14, and thus into the flow of fluid F. A series of sensor assemblies 22C are provided at spaced apart locations on the arms 78, 79. So that by urging arms 78, 79 radially outward, the sensor assemblies 22C are also selectively put into the flow of fluid F. As discussed above, sensor assembly 22C includes a fluid property sensor 26 (FIG. 1), which in an example is a non-mechanical means for analyzing a fluid downhole. As the sensor assemblies 22C are spaced axially apart at known locations, fluid velocity of the flow of F can be estimated based on observing changes in fluid properties at each sensor assembly 22C, and recording the specific time the changes were observed. Correlating similar responsive observations at the axially spaced apart sensor assemblies 22C over time, and then dividing the spaced apart distance with the correlated time, can yield an estimate of fluid velocity. Knowing the fluid velocity and the tubular cross sectional area, the overall flow rate of fluid F can then be estimated. An advantage of using the non-mechanical fluid property sensors, over that of a spinner or other mechanical device, is that fluid energy is not diminished during the step of observing, and the likelihood of mechanical failure is reduced.

Figure 5:
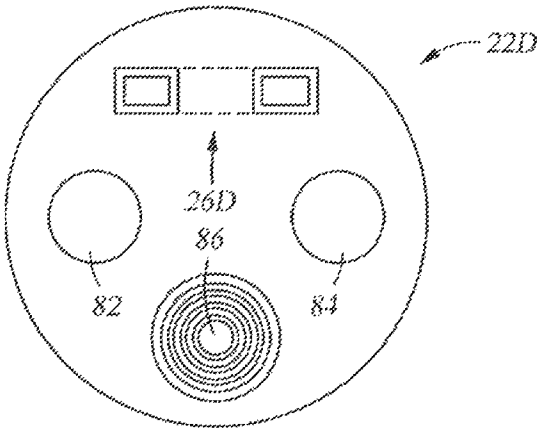
FIG. 5 is an end view of an alternate example of a sensor assembly.

FIG. 5 is an end view of an alternate example of sensor assembly 22D, wherein further included with the fluid property sensor 26D are examples of a temperature sensor 82, a pressure sensor 84, and an medium 86. In the illustrated example, medium 86 is an optical transparent medium, and that selectively transmits optical signals. Accordingly, the additional advantages of colocation of sensors is realized by the placement of these devices so that multiple types of fluid data is recordable at substantially the same position in a wellbore. FIG. 6 illustrates in a side sectional view an example of the medium 86, which in the is example is a fiber optic member, and which is circumscribed by a sheath 88. As illustrated, sheath 88 includes a series of conductors $\mathbf{90}_{1\text{-}n}$, wherein the conductors $\mathbf{90}_{1\text{-}n}$ can conduct signals, electricity, or both. Insulating file layers $\mathbf{92}_{1\text{-}n}$ are provided between each of the adjacent conductors $\mathbf{90}_{1\text{-}n}$. The conductors $\mathbf{90}_{1\text{-}n}$ provide a transmission medium for signals to and from the other sensors in the sensor assembly 22. An advantage of packaging arrangement is that signals can from all sensors in the sensor assembly can be transmitted in a bits or harness arrangement that requires significantly less space than what is required for traditional configurations. Further illustrated in the example of FIG. 6 is a light source 94 for emitting an optical signal through the medium 86, an output coupler 96 that allows light from the light source to travel through the medium 86 and to its end 98. As shown in FIG. 6, the end 98 of the medium 86 is beveled or angled; which in one example is at a designated angle, such as the critical angle of reflection for oil, gas, and/or water. In the illustrated example, end 98 is a reflective surface in contact with localized fluid flow. Reflected light making its way back from the end 98 into the medium 86 that reaches the output coupler 96, is reflected laterally from the medium 86 to a light detector 100. The light received by the light detector 100 can be communicated to the controller 64 for recording and analysis of the fluid F. The reflected light intensity in end 98, and measured in light detector 100, is a function of the reflectance of the surface of end 98 based on the fluid flow F refractive index. In an embodiment, the reflected light intensity measured by light detector 100 can be used to provide an indication of size distribution and frequency of gas bubbles that may be present in the fluid flow F; which can provide data indicating production flow dynamics.

Further optional examples of temperature sensors include a temperature sensor which has a resistance sensitive to temperature as it is exposed to the fluid causes the resistance of the sensor resistance to vary in response to the fluid temperature. The resistance can be measured by a direct current, alternate current or pulsed current and can be used to derive a temperature measurement. The pulsed current helps to increase the sensitivity of the temperature sensor to also sense fluid flow velocity resulting in a resulting pulsing measured resistance value which is affected by the fluid temperature, the fluid's specific heat (correlated to the density) and fluid flow rate (fluid velocity—can assume fluid temperature is relatively constant). The pulsed method can be similar to heated wire anemometry techniques. The collocated sensor measurements have density and flow rate measurements to assist in the corrections for a temperature sensor measurement with temperature sensing element in contact with the fluid. The gas phase of a three-phase flow can result in a smaller decay of the pulsed resistance due to its lower specific heat and lower density. Therefore the temperature sensor can be used to develop a combined assessment of the fluid temperature, fluid velocity and fluid density (often correlated to fluid specific heat—calories required to raise a specific mass by a specific temperature change; For example, water requires 1 calorie to raise 1 gram by 1° C., oil and gas would be expected to have lower specific heat values.

In an example, Bernoullis' equation is employed for flow evaluation, which allows the use of pressure, temperature and flow rate measurements to make assessment of production issues in a producing well or group of wells and producing completion points. An advantage of obtaining fluid flow measurements that are collocated is that it allows a fluid dynamics balance assessment of the net three-phase fluid flow parameters and conditions or each of the well fluid phase flow components utilizing the Bernoulli's equation. Each phase flow could have different flow rates and be producing at different temperatures at the inlet point as they flow out of the reservoir and into the production tube. Production assessment can be made below (higher MD—measured depth) the producing point, at the producing point or above (lower MD—measured depth) to understand the fluid producing dynamics issues and difficulties of the particular well by flow phase or all phases together. The ability to have a breakout of the different fluid types being produced in the liquid phase and their relative flow rates is also an advantage.

In another example, cross correlation of measurements taken by sensor assemblies 22A-C disposed at different spatial locations in the flow of fluid F can be performed to obtain additional information about the flow of fluid F. For example, cross correlating the time at which a measurement is taken by spatially set apart sensor assemblies 22A-C, can yield velocity of the fluid when the same fluid properties are measured by sensor assemblies 22A-C that are at known distances from one another. Further, strategically disposed sensor assemblies 22A-C can provide an indication of not only fluid phase (i.e. fluid, gas, multi-phase flow), but of its structure (i.e. stratified, plug flow, slug flow, annular flow). All or some of the properties of the fluid in the flow of fluid F can be cross correlated.

The present invention described herein, therefore, is well adapted to carry out the objects and attain the ends and advantages mentioned, as well as others inherent therein. While a presently preferred embodiment of the invention has been given for purposes of disclosure, numerous changes exist, in the details of procedures for accomplishing the desired results. For example, the device can be permanently or temporarily disposed downhole. These and other similar modifications will readily suggest themselves to those skilled in the art, and are intended to be encompassed within the spirit of the present invention disclosed herein and the scope of the appended claims.

What is claimed is:

1. A downhole device for use in a wellbore comprising:
- a first housing;
- a spindle on an end of the first housing;
- a fluid sensor assembly mounted on the spindle and selectively disposed in a flow of fluid in the wellbore and that comprises,
  - a fluid flow meter having a second housing that rotatingly couples to the spindle, a frame coupled with the second housing, openings formed through the frame, and rotatable members on the frame that are in contact with the flow of fluid, and
  - a fluid property sensor set at a location proximate the fluid flow meter and in communication with the flow of fluid through the openings, so that fluid in the flow of fluid has fluid properties that are substantially the same when fluid contacts the members and when the fluid is sensed by the fluid property sensor.

2. The downhole device of claim 1, wherein the frame has a cylindrically shaped outer surface, and wherein the openings are in the surface so that fluid in the flow of fluid flows through the openings to the fluid property sensor.

3. The downhole device of claim 1, further comprising an electromagnetic source in one of the spindle or the second housing that is sensed by an electromagnetic receive disposed in the other one of the spindle or second housing.

4. The downhole device of claim 1, wherein the fluid property sensor comprises a resonating member, and wherein the member is damped by fluid flowing across the member.

5. A method of monitoring a flow of fluid in a wellbore comprising:
- monitoring a rate of rotation of a rotating frame disposed in the flow of fluid to estimate flow rate of the flow of fluid at a location in the wellbore; and
- monitoring a property of the fluid in the flow of fluid in the wellbore by sensing fluid from the flow of fluid that flows through openings in the rotating frame and into a space within the rotating frame, where properties of the fluid are substantially the same as properties of the fluid at the location in the wellbore.

6. The method of claim 5, wherein blade like members mount to the frame and which induce a rotating motion to the frame in response to the flow of fluid contacting the members, and wherein the frame and blade like members comprise a flow meter.

7. The method of claim 5, wherein the steps of monitoring the flow rate of the flow of fluid and monitoring the property of the fluid in the flow of fluid occur at substantially the same time.

8. The method of claim 5, wherein the step of monitoring a property of the fluid in the flow of fluid comprises using a controller to apply a resonating frequency to an elongate member that is disposed in a space within the frame, and measuring an amount of damping exerted onto the elongate member by the flow of fluid.

9. The method of claim 5, wherein the property of the fluid being measured comprises density, the method further comprising monitoring viscosity of the fluid and a refractive index of the fluid, wherein the refractive index is monitored with a fiber optic member encased in alternating layers of a conductor and an insulator.

10. The method of claim 5, further comprising estimating information about the composition of the flow of fluid based on the steps of monitoring.

* * * * *